US011236898B2

(12) United States Patent
Tan et al.

(10) Patent No.: US 11,236,898 B2
(45) Date of Patent: Feb. 1, 2022

(54) TRACK LIGHT

(71) Applicant: OPPLE LIGHTING CO., LTD., Shanghai (CN)

(72) Inventors: Xingchen Tan, Shanghai (CN); Jia Xu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/138,883

(22) Filed: Dec. 30, 2020

(65) Prior Publication Data

US 2021/0116120 A1 Apr. 22, 2021

Related U.S. Application Data

(63) Continuation of application No. PCT/CN2019/097133, filed on Jul. 22, 2019.

(30) Foreign Application Priority Data

Jul. 25, 2018 (CN) ..... 201810825743.0
Jul. 25, 2018 (CN) ..... 201821187374.9

(51) Int. Cl.
*F21V 23/06* (2006.01)
*F21S 8/06* (2006.01)
(Continued)

(52) U.S. Cl.
CPC ..... *F21V 23/06* (2013.01); *F21S 8/066* (2013.01); *F21V 21/088* (2013.01);
(Continued)

(58) Field of Classification Search
CPC ..... F21V 23/06; F21V 23/088; F21V 23/096; F21V 23/002; F21V 23/003; F21S 8/066
(Continued)

(56) References Cited

U.S. PATENT DOCUMENTS 7,762,821 B2 * 7/2010 Patterson ..... H02G 3/381 439/121
8,915,609 B1 * 12/2014 Shah ..... F21V 21/096 362/183
(Continued)

FOREIGN PATENT DOCUMENTS

CN 201599752 U 10/2010
CN 201925881 U 8/2011
(Continued)

OTHER PUBLICATIONS

International Search Report of PCT Application No. PCT/CN2019/097133 dated Oct. 29, 2019 with English translation, (6p).

*Primary Examiner* — Bryon T Gyllstrom
(74) *Attorney, Agent, or Firm* — Arch & Lake LLP

(57) ABSTRACT

A track light is provided. The track light includes a guide track, a driving power source, and a light source. The guide track may include a track housing and a conductive cable. The track housing may include an accommodating cavity, the accommodating cavity may include a connection opening, and the conductive cable may be fixed in the accommodating cavity. The driving power source may include a driving housing, an elastic conductive terminal and an output terminal, the elastic conductive terminal may pop out of the driving housing, and the output terminal may be located at a side of the driving housing and may be electrically connected with the elastic conductive terminal. The light source may include a light emitting component and an input terminal, the light emitting component may be electrically connected with the input terminal.

15 Claims, 5 Drawing Sheets

(51) Int. Cl.
*F21V 21/088* (2006.01)
*F21V 21/096* (2006.01)
*F21V 23/00* (2015.01)

(52) U.S. Cl.
CPC ..... *F21V 21/096* (2013.01); *F21V 23/002* (2013.01); *F21V 23/003* (2013.01)

(58) Field of Classification Search
USPC ..... 362/217.16
See application file for complete search history.

(56) References Cited

U.S. PATENT DOCUMENTS 9,353,913 B2 * 5/2016 Allen ..... H05B 45/10
9,923,341 B1 * 3/2018 Andersson ..... H02G 5/00
2005/0254263 A1 * 11/2005 Harwood ..... F21V 21/30 362/648
2006/0262521 A1 * 11/2006 Piepgras ..... F21V 29/83 362/149
2008/0212323 A1 * 9/2008 Chien ..... G01S 3/7864 362/249.07
2009/0279298 A1 * 11/2009 Mier-Langner .... H01R 13/6205 362/235
2011/0242811 A1 * 10/2011 Cheng ..... H01R 25/142 362/249.03
2013/0182422 A1 * 7/2013 Guilmette ..... F21V 7/28 362/184
2015/0316238 A1 * 11/2015 Guilmette ..... F21V 21/30 362/218
2017/0082266 A1 * 3/2017 Ruhland ..... F21S 8/066
2019/0249854 A1 * 8/2019 Shen ..... F21V 23/0435

FOREIGN PATENT DOCUMENTS

CN 201983038 U 9/2011
CN 104235686 A 12/2014
CN 204187403 U 3/2015
CN 204513291 U 7/2015
CN 107388108 A 11/2017
CN 108826114 A 11/2018
CN 208620128 U 3/2019
DE 202004020011 U1 4/2005

* cited by examiner

TRACK LIGHT

CROSS-REFERENCE TO RELATED APPLICATION

This application is based upon and claims the priority of PCT patent application No. PCT/CN2019/097133 filed on Jul. 22, 2019 which claims priority to the Chinese patent application No. 201810825743.0 filed on Jul. 25, 2018 and the Chinese patent application No. 201821187374.9 filed on Jul. 25, 2018, the entire content of all of which is hereby incorporated by reference herein for all purposes.

TECHNICAL FIELD

This disclosure relates to a technical field of lighting, and more particularly, to a track light.

BACKGROUND

With the more and more obvious diversity and differentiation of lighting demands of people, the demands of the people have not been satisfied by a track light with a fixed structure, and on this premise, a track light of which a light source module and a driving power source can be arbitrarily regulated on positions appears.

However, when connecting the light source module and the driving power source, the track light in the prior art mainly aims at satisfying the convenience of mechanical installation, but is relatively complicated in structure in terms of electric connection and particularly a structure of electric connection between the driving power source and a track, and therefore, relatively long time is spent on assembly.

SUMMARY

Examples of the present disclosure provides a track light.

According to a first aspect, the present disclosure provides a track light. The track light may include a guide track, a driving power source, and a light source. The track light may further include a length direction, a width direction and a thickness direction. The guide track may include a track housing and a conductive cable extending along the length direction. The track housing may include an accommodating cavity, the accommodating cavity may include a connection opening located in the thickness direction, and the conductive cable may be fixed in the accommodating cavity. The driving power source may include a driving housing, an elastic conductive terminal and an output terminal, the elastic conductive terminal may pop out of the driving housing, and the output terminal may be disposed at a side of the driving housing and is electrically connected with the elastic conductive terminal. The light source may include a light emitting component and an input terminal, the light emitting component may be electrically connected with the input terminal, and the input terminal is connected with the output terminal. The elastic conductive terminal, when the driving power source and the light source are into the accommodating cavity through the connection opening, may be electrically connected with the conductive cable.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate examples consistent with the present disclosure and, together with the description, serve to explain the principles of the disclosure.

DETAILED DESCRIPTION

Reference will now be made in detail to example embodiments, examples of which are illustrated in the accompanying drawings. The following description refers to the accompanying drawings in which the same numbers in different drawings represent the same or similar elements unless otherwise represented. The implementations set forth in the following description of example embodiments do not represent all implementations consistent with the disclosure. Instead, they are merely examples of apparatuses and methods consistent with aspects related to the disclosure as recited in the appended claims.

The terminology used in the present disclosure is for the purpose of describing particular embodiments only and is not intended to limit the present disclosure. As used in the present disclosure and the appended claims, the singular forms "a," "an," and "the" are intended to include the plural forms as well, unless the context clearly indicates otherwise. It shall also be understood that the term "and/or" used herein is intended to signify and include any or all possible combinations of one or more of the associated listed items.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to a judgment" depending on the context.

The technical solutions provided by each embodiment of the present disclosure will be described in detail with reference to the attached drawings.

An embodiment of the present disclosure discloses a track light, as shown in FIG. 1 to FIG. 6, including a track 1, a driving power source 2 and a light source 3. Generally, the track light is of a strip-shaped structure. In order to facilitate describing the structure, the track light is defined by adopting a length direction X, a width direction Y and a thickness direction Z in the present embodiment.

Figure 1:
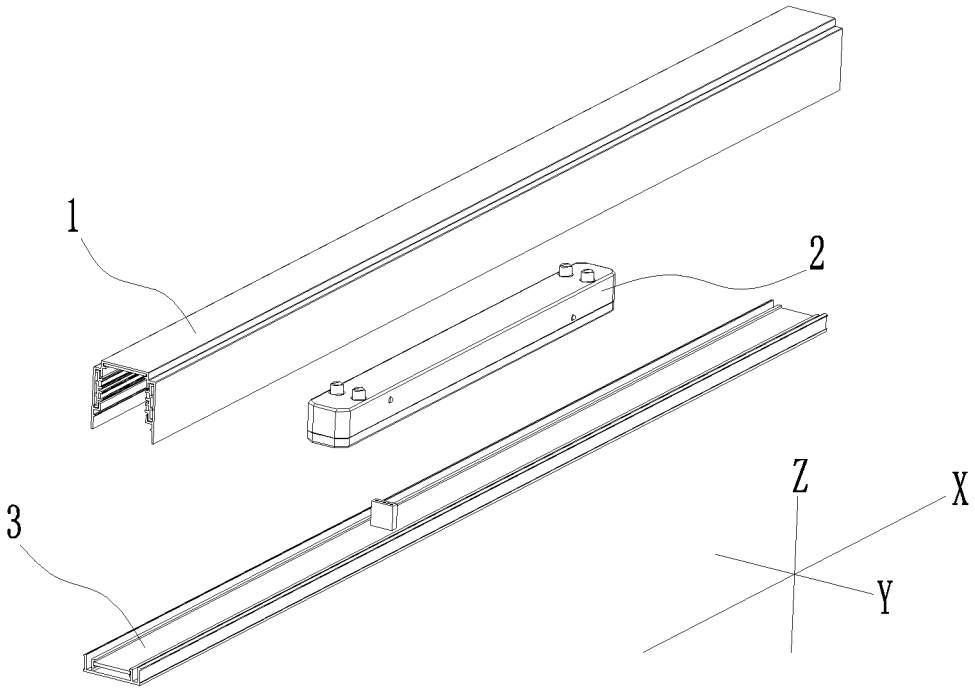
FIG. 1 is an exploded view of a track light according to an embodiment of the present disclosure.
Figure 5:
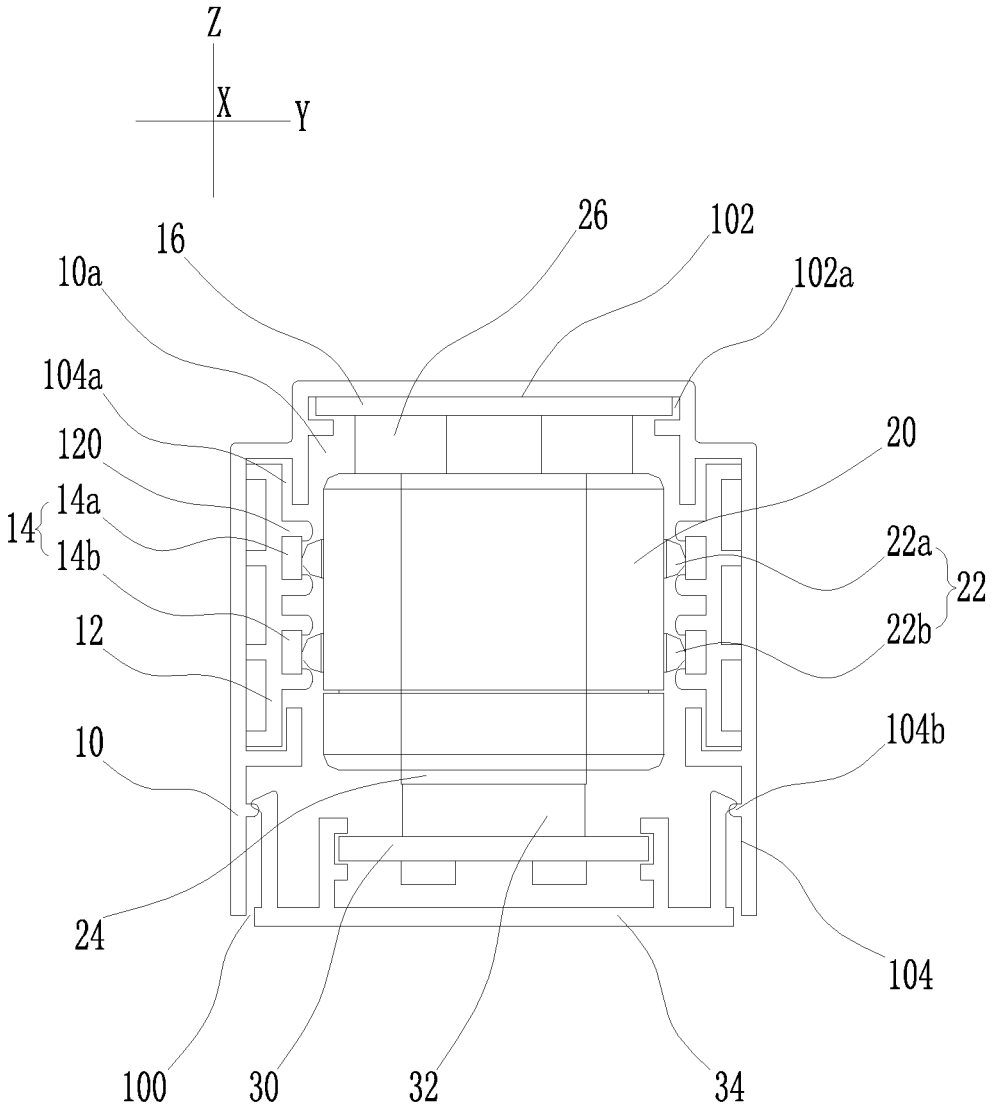
FIG. 5 is a side view of the track light according to an the embodiment of the present disclosure.
Figure 6:
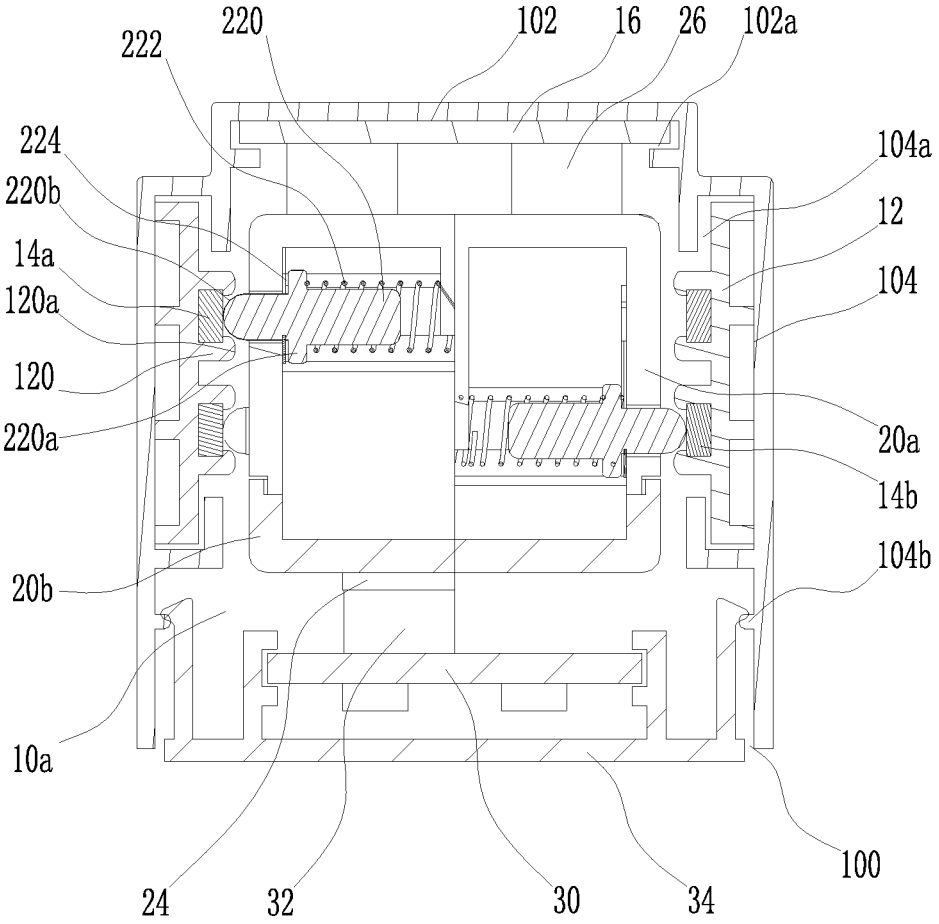
FIG. 6 is a side view of the track light with a partial sectional structure according to an embodiment of the present disclosure.

The guide track 1 is used as a basic structure of the track light and is configured for fixing the driving power source 2 and the light source 3; and meanwhile, the guide track 1 also provides power for the driving power source 2. In particular, as shown in FIG. 1, FIG. 5 and FIG. 6, the guide track 1 includes a track housing 10, insulating members 12 and conductive cables 14, which extend in the length direction X.

Herein, the track housing 10 is generally an aluminum extruded housing which is good in appearance, high in structural strength, favorable in molding process and relatively good in overall performances. An accommodating cavity 10*a* is formed by being surrounded by the track housing 10; the accommodating cavity 10*a* includes a connection opening 100 in the thickness direction Z and a cavity bottom 102 opposite to the connection opening 100; the accommodating cavity 10*a* further includes two cavity walls 104 adjacent to the connection opening 100 in the width direction Y and oppositely disposed. The insulating members 12 are configured for fixing the conductive cables 14 and isolating electric energy to avoid short circuits. In particular, the insulating members 12 are fixedly disposed in the accommodating cavity 10*a*; in this case, the insulating members 12 can be fixedly disposed on the cavity bottom 102; the insulating members 12 can also be fixedly disposed on the cavity walls 104. The side, facing to the center of the accommodating cavity 10*a*, of the insulating members 12 are provided with cable slot 120, and the conductive cables 14 are fixedly disposed in the cable slot 120. The conductive cable 14 itself is provided with exposed conductive surface extending in the length direction X, and electric energy can be transmitted at any point on the conductive surface. It should be noted that, in some embodiments, it is possible that the track housing 10 is made of an insulating material; in this case, it is possible that the insulating members 12 are directly fixed on the track housing 10, without provision of the conductive cables 14.

In the present embodiment, the driving power source 2 is configured for obtaining electric energy from the guide track and transmit electric energy to the light source 3. In particular, as shown in FIG. 2, FIG. 3, FIG. 5 and FIG. 6, the driving power source 2 includes a driving housing 20, elastic conductive terminals 22 and an output terminal 24, and in addition, generally further includes a driving board 28. Terminal guide slots 200 can be provided inside the driving housing 20, for guiding the elastic conductive terminals 22; the elastic conductive terminals 22 are disposed in the terminal guide slots 200 and can only be popped out of the driving housing 20 along the terminal guide slots 200. According to different positions of the conductive cables 14, extension directions of the terminal guide slots 200 are different. For example, when the conductive cables 14 are disposed at one side of the cavity bottom 102 along the thickness direction Z, the terminal guide slots 200 are also disposed along the thickness direction Z; and when the conductive cables 14 are disposed at one side of the cavity wall 104 along the width direction Y, the terminal guide slots 200 are also disposed along the width direction Y.

The driving board 28 is also mounted in the driving housing 20 and is configured for switching and controlling the power source. In order to conveniently mount the elastic conductive terminals 22 and the driving board 28 into the driving housing 20, the driving housing 20 in the present embodiment can be divided into two parts, that is, an upper housing 20*a* and a lower housing 20*b*; and the two parts are connected by a structure such as a screw and a buckle.

Figure 3:
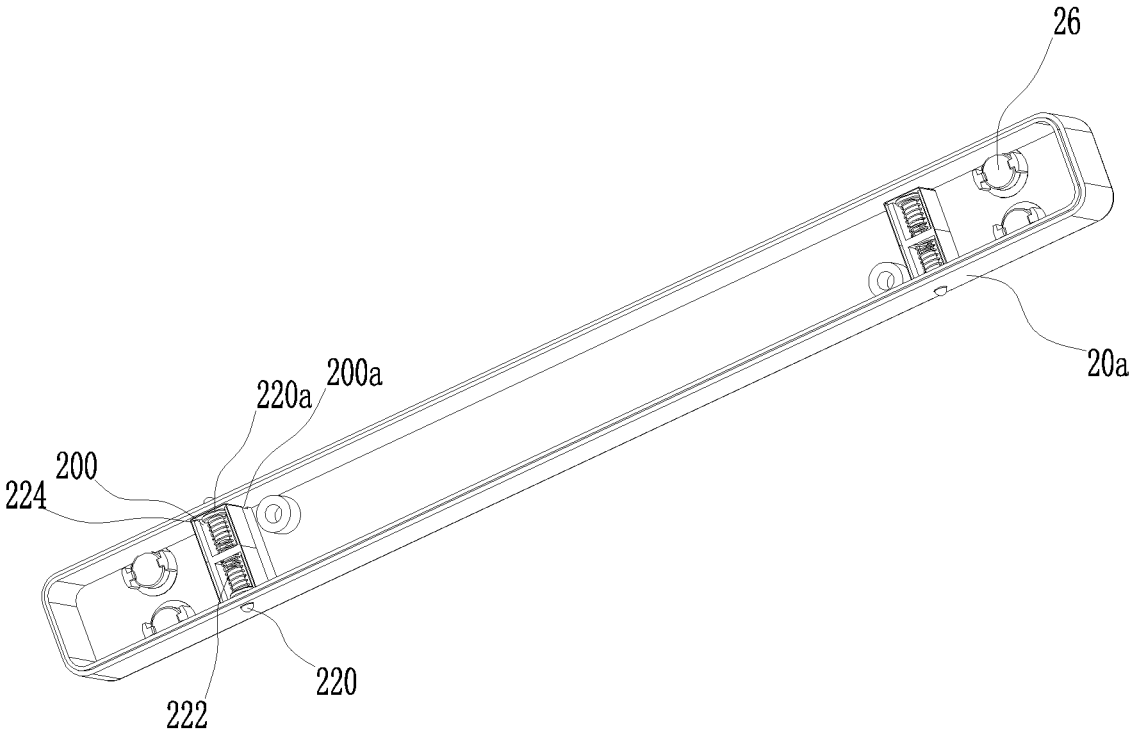
FIG. 3 is a sectional view of an upper housing, in an assembly state, of a driving power source according to an embodiment of the present disclosure.
Figure 4:
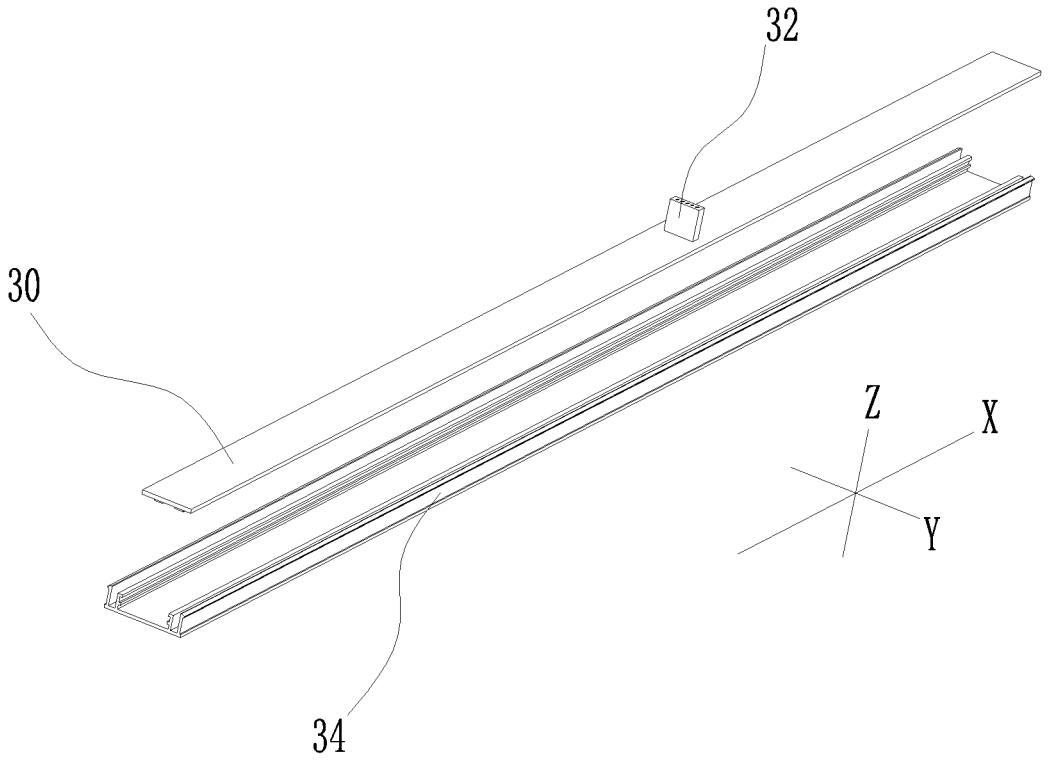
FIG. 4 is an exploded view of a light source according to an embodiment of the present disclosure.

As shown in FIG. 3, the light source 3 generally includes a light emitting component 30 and an input terminal 32; and the light emitting component 30 is electrically connected with the input terminal 32. An electric connection process of the light source 3 can be realized by connecting the input terminal 32 of the light source 3 to the output terminal 24 after the driving power source 2 is mounted. The input terminal 32 and the output terminal 24 can adopt a male and female terminal structure or a pin and elastic metal sheet matched structure and can further adopt various connection structures such as a golden finger connection structure, a pin connection structure and even a welded structure.

The present embodiment, the cable slots 120 and the elastic conductive terminals 22 can be provided with guide surfaces for cooperation. When the driving power source 2 is placed into the accommodating cavity 10*a* through the connection opening 100, with the gradual deepening of the driving power source 2 into the accommodating cavity 10*a*, the elastic conductive terminals 22 are capable of retracting towards the inside of the driving housing 20 under the guide of the guide surfaces; and the elastic conductive terminals 22, by virtue of its elasticity, can be re-popped out and extend into the cable slots 120 in the width direction Y after crossing the guide surfaces, to electrically connected with the conductive cables 14. The process of electric connection between the driving power source 2 and the guide track 1 is very simple, so that the assembly time is greatly shortened.

The output terminal 24 is disposed at one side of the driving housing 20 in the thickness direction Z and is electrically connected with the elastic conductive terminals 22. For example, the elastic conductive terminals 22 and the output terminal 24 are electrically connected with the driving board 25 at the same time.

Figure 2:
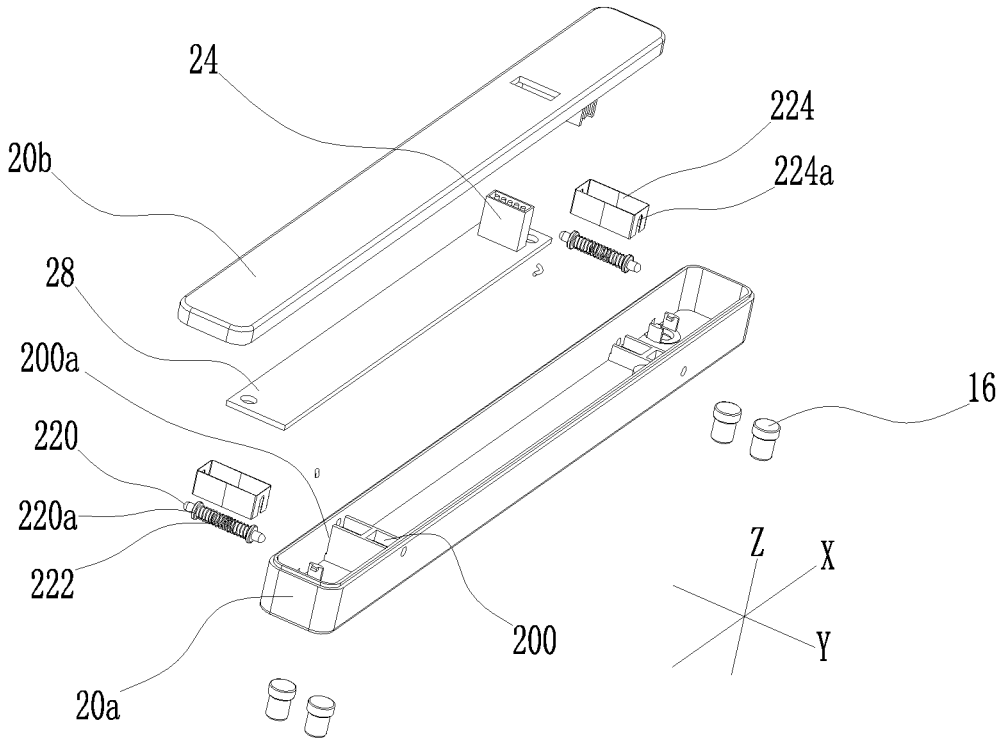
FIG. 2 is an bottom and exploded view of a driving power source according to an embodiment of the present disclosure.

As shown in FIG. 2, FIG. 3 and FIG. 6, the elastic conductive terminals 22 in the present embodiment can include conductive pins 220, elastic members 222 and conductive sheets 224. The conductive pins 220 are configured to extend out of the driving housing 20 and are electrically connected with the conductive cables 14. The conductive pins 220 are provided with abutting parts 220*a*. When the elastic conductive terminal 22 is disposed in the terminal guide slot 200, two ends of the elastic member 222 are respectively abutted with the abutting part 220*a* and the terminal guide slot 200 and apply an acting force for extending out of the driving housing 20 to the conductive pin 220. The elastic members 222 can adopt various elastic structures such as spring and elastic sheet. The conductive sheet 224 is disposed at a side of the abutting part 220*a* facing away from the elastic member 222, and is abutted with the abutting part 220*a* when the conductive pin 220 is electrically connected with the conductive cables 14. In this case, the output terminal 24 can be electrically connected with the conductive sheets 224 so as to achieve a stable electric connection structure.

The conductive sheets 224 may be provided with assembly gaps 224*a*, and the conductive pins 220 extend into the assembly gaps 224*a*, in this way, the conductive sheets 224 can be at least abutted and matched with the abutting parts 220*a* from two sides of the conductive pin 220; and therefore, the stability of electric connection can be improved. In order to fix the conductive sheets 224, the terminal guide slots 200 can be provided with clamping connection openings 200*a*; and the conductive sheet 224 is in clamping connection with and fixedly disposed in the clamping connection opening 200*a*. In addition, two ends of the conductive sheet 224 can also be bent or folded, so that the conductive sheet 224 become into a three-dimensional structure from a sheet to further improve the stability.

In the present embodiment, the guide surfaces can be disposed in the cable slots 120 only; for example, edges of clamping hooks of the cable slots 120 are designed to be first guide surfaces 120*a* which are arc-shaped or obliquely extend. The guide surfaces can also be disposed on the elastic conductive terminals 22 only; for example, ends of the conductive pins 220 are designed to be second guide surfaces 220*b* which are arc-shaped. Of course, it is possible that the first guide surfaces 120*a* and the second guide surfaces 220*b* present at the same time, so that a more excellent guide effect is provided. Moreover, the specific shapes of the guide surfaces in the present embodiment are not particularly limited as long as a guide function is achieved.

A circuit is required to be formed for electric connection; and therefore, two electrodes with opposite electric properties are generally required to be connected at the same time. In the present embodiment, in order to improve the safety, a single one conductive cable 14 can be only used as one electrode. Therefore, in order to form the circuit, the conductive cables 14 in the present embodiment include first conductive cables 14*a* and second conductive cables 14*b* which have opposite electric properties; the first conductive cable 14*a* and the second conductive cable 14*b* are required to be mutually staggered in the thickness direction Z; that is, they are different in distance from the connection opening 100. The elastic conductive terminals 22 also include first elastic conductive terminals 22*a* and second elastic conductive terminals 22*b*; the first elastic conductive terminal 22*a* and the second elastic conductive terminal 22*b* can have the identical structure, but are also required to be mutually staggered in the thickness direction Z. When the driving power source 2 is mounted at a preset position, the first elastic conductive terminals 22*a* are electrically connected with the first conductive cables 14*a*, and the second elastic conductive terminals 22*b* are electrically connected with the second conductive cables 14*b*, so that a connection circuit is formed.

Furthermore, in order to improve the stability of electric connection, two first conductive cables 14*a* and two second conductive cables 14*b* can be disposed at the same time in the present embodiment, the two first conductive cables 14*a* are oppositely disposed in the width direction Y, and the two second conductive cables 14*b* are also oppositely disposed in the width direction Y.

Meanwhile, on the driving power source 2, the number of the first elastic conductive terminals 22*a* and the number of the second elastic conductive terminals 22*b* are both two; the two first elastic conductive terminals 22*a* are disposed back to back in the width direction Y and are electrically connected with different first conductive cables 14*a* respectively; the two second elastic conductive terminals 22*b* are also disposed back to back in the width direction Y and are electrically connected with different second conductive cables 14*b* respectively. Structures for fixing the elastic conductive terminals 22 at two sides can be identical or different as long as there are no substantial influences to electric connection property. For example, the elastic conductive terminals 22 can be fixedly disposed by the insulating members 12 respectively disposed at two sides.

In this way, the driving power source 2 can be electrically connected with the two separately disposed elastic conductive terminals 22 at the same time when extending into the accommodating cavity 10*a*, which is equivalent to that two circuits connected in parallel are formed; therefore, the safety can be increased exponentially. The insulating members 12 can be fixed on the cavity walls 104 in a clamping connection way; for example, the walls 104 are provided with first clamping slots 104*a*, and the insulating members 12 are clamped inside the first clamping slots 104*a*. For example, when the driving power source 2 enters into the accommodating cavity 10*a*, at each of two opposite sides of the driving power supply 2 in the width direction Y, the first conductive cable 14*a* and the second conductive cable 14*b* can be electrically connected with the first elastic conductive terminal 22*a* and the second elastic conductive terminal 22*b* respectively.

In the present embodiment, in order to rapidly mount the driving power source 2, the cavity bottom 102 of the guide track 1 can be provided with first magnetic members 16. Similar to the way of fixing the insulating members 12, the first magnetic members 16 can be clamped and fixed on the cavity bottom 102 by the second clamping slots 102*a* provided on the cavity bottom 102. Meanwhile, second magnetic members 26 are provided inside the driving power source 2; the second magnetic members 26 can be fixed at the side of the driving housing 20 facing away from the output terminal 24.

When the driving power source 2 is placed into the guide track 1 through the connection opening 100, the first magnetic members 16 and the second magnetic members 26 are capable of generating magnetic adsorption effects so as to be rapidly close to each other and finally fixedly connected together. During magnetic adsorption, electric connection between each of the elastic conductive terminals 22 and each of the conductive cables 14 can also be automatically completed. When the position of the driving power source 2 is required to be moved, it can be realized just by pulling the driving power source 2 against friction force. In the present embodiment, both the first magnetic members 16 and the second magnetic members 26 can be magnets; however, the cost is relatively high. Preferably, the first magnetic member 16 can adopt magnetic metal plate such as iron plate; and the magnetic metal plate can extend to any position of the guide track 1 in the length direction X; and the second magnetic members 26 adopt magnet such as magnetic stone; and the magnetic metal plate is adsorbed by the magnets. The magnetic metal plate is low in price; and therefore, the cost can be effectively reduced. The magnets can be fixed on the driving housing 20 by structure such as clamping hook.

The light source 3 can adopt a spotlight, a downlight and the like or adopt a linear module; the light source 3 of linear module generally further includes a lens 34 configured for distributing light for the light emitting component 30. In order to fix the lens, structures such as clamping bars 104*b* can be disposed on the cavity walls 104 to clamp and fix the lens 34; and the lens 34 can cover the connection opening 100 after being fixed. In this case, the light emitting component 30 can be fixedly connected with the lens 34, so that the structural stability of the light emitting component 30 and the lens 34 is improved.

By using the track light provided by the embodiment of the present disclosure, the assembly time can be saved.

In one or more embodiments, in a track light, the accommodating cavity comprises a cavity bottom opposite to the connection opening in the thickness direction and two cavity walls close to the connection opening which are oppositely disposed in the width direction, the conductive cable is located at a side of the accommodating cavity along the width direction, and the elastic conductive terminal is only capable of being popped out of the driving housing along the width direction.

In one or more embodiments, in a track light, the track light further comprises an insulating member fixed in the accommodating cavity, a side of the insulating member facing away from the cavity wall is provided with a cable slot, and the conductive cable is fixed in the cable slot.

In one or more embodiments, in a track light, the cable slot and/or the elastic conductive terminal are provided with guide surface(s), when the driving power source is into the accommodating cavity through the connection opening, the elastic conductive terminal is capable of retracting towards an inside of the driving housing under the guide of the guide surface(s), and the elastic conductive terminal is capable of extending into the cable slot along the width direction after crossing the guide surface(s) and is electrically connected with the conductive cable.

In one or more embodiments, in a track light, the conductive cable comprises a first conductive cable and a second conductive cable with opposite electric properties, the first conductive cable and the second conductive cable are mutually staggered in the thickness direction, the elastic conductive terminal comprises a first elastic conductive terminal and a second elastic conductive terminal, the first elastic conductive terminal and the second elastic conductive terminal are mutually staggered in the thickness direction, the first elastic conductive terminal is electrically connected with the first conductive cable, and the second elastic conductive terminal is electrically connected with the second conductive cable.

In one or more embodiments, in a track light, two of the first conductive cables and two of the second conductive cables are provided, the two of the first conductive cables are oppositely disposed along the width direction, and the two of the second conductive cables are oppositely disposed along the width direction; two of the first elastic conductive terminals and two of the second elastic conductive terminals are provided, the two of the first elastic conductive terminals are disposed back to back along the width direction and are electrically connected with the different first conductive cables respectively, and the two second elastic conductive terminals are disposed back to back along the width direction and are electrically connected with the different second conductive cables respectively.

In one or more embodiments, in a track light, a terminal guide slot extending along the width direction is provided inside the driving housing, and the elastic conductive terminal is disposed in the terminal guide slot.

In one or more embodiments, in a track light, the elastic conductive terminal comprises a conductive pin, an elastic member and a conductive sheet; the conductive pin is configured to extend out of the driving housing and electrically connect with the conductive cable, the conductive pin is further provided with an abutting part, two ends of the elastic member is abutted with the abutting part and the terminal guide slot respectively, and the elastic member applies an acting force to make the conductive pin extend out of the driving housing, the conductive sheet is disposed at a side of the abutting part facing away from the elastic member and abutted with the abutting part when the conductive pin is electrically connected with the conductive cable, and the output terminal is electrically connected with the conductive sheet.

In one or more embodiments, in a track light, the conductive sheet is provided with an assembly gap, and the conductive pin extends in through the assembly gap.

In one or more embodiments, in a track light, the terminal guide slot is provided with a clamping connection opening, and the conductive sheet is clamped into the clamping connection opening.

In one or more embodiments, in a track light, the cavity wall is provided with a first clamping slot, and the insulating member is in clamping connected in the first clamping slot.

In one or more embodiments, in a track light, the guide track comprises a first magnetic member fixed on the cavity bottom, the driving power source comprises a second magnetic member fixed at a side of the driving housing facing away from the output terminal, and the first magnetic member and the second magnetic member are capable of being fixedly connected by magnetic adsorption.

In one or more embodiments, in a track light, the cavity bottom is provided with a second clamping slot, and the first magnetic member is fixed in the second clamping slot.

In one or more embodiments, in a track light, the first magnetic member is a magnetic metal plate, and the second magnetic member is a magnet.

In one or more embodiments, in a track light, the light source further comprises a lens covering the connection opening and in clamping connection with the accommodating cavity, and the light emitting component is fixedly connected with the lens.

At least one of the above-mentioned technical solutions adopted in the embodiments of the present disclosure can achieve the following beneficial effects:

The track light disclosed in the embodiments of the present disclosure is capable of achieving automatic electric connection between an elastic conductive terminal and a conductive cable when the driving power source enters into an accommodating cavity from a connection opening, thereby saving the assembly time.

In the above embodiments of the present disclosure, the differences among the respective embodiments are particularly described; different optimization features among the respective embodiments can be combined to form a better embodiment as long as they are not contradictory. Considering the brevity of description, they will not be repeated herein.

The above described is only embodiments of the present disclosure, and is not intended to limit the present disclosure. For those skilled in the art, various modifications and variations are possible. Any modification, equivalent substitution, improvement, and the like made within the spirit and principle of the present disclosure shall be included within the scope of the claims of the present disclosure.

What is claimed is:

1. A track light, comprising:

a guide track, wherein the track light comprises a length direction, a width direction and a thickness direction, a driving power source, and a light source;

wherein the guide track comprises a track housing and a conductive cable extending along the length direction; wherein the track housing comprises an accommodating cavity, the accommodating cavity comprises a connection opening located in the thickness direction, the conductive cable is fixed in the accommodating cavity, and the accommodating cavity further comprises a cavity bottom opposite to the connection opening in the thickness direction, and two cavity walls close to the connection opening, wherein the two cavity walls are oppositely disposed along the width direction;

wherein the driving power source comprises a driving housing, an elastic conductive terminal and an output terminal, the elastic conductive terminal pops out of the driving housing, and the output terminal is disposed at a side of the driving housing and is electrically connected with the elastic conductive terminal;

wherein the light source comprises a light emitting component and an input terminal, the light emitting component is electrically connected with the input terminal, and the input terminal is connected with the output terminal;

wherein, when the driving power source and the light source are into the accommodating cavity through the connection opening, the elastic conductive terminal is electrically coupled with the conductive cable.

2. The track light according to claim 1, wherein the conductive cable is located at a side of the accommodating cavity in the width direction, and the elastic conductive terminal pops out of the driving housing along the width direction.

3. The track light according to claim 2, wherein the track light further comprises an insulating member fixed in the accommodating cavity, a side of the insulating member facing away from the cavity wall is provided with a cable slot, and the conductive cable is fixed in the cable slot.

4. The track light according to claim 3, wherein the cable slot and/or the elastic conductive terminal are provided with at least one guide surface, when the driving power source is into the accommodating cavity through the connection opening, the elastic conductive terminal is capable of retracting towards an inside of the driving housing under the guide of the at least one guide surface, and the elastic conductive terminal is capable of extending into the cable slot along the width direction after crossing the at least one guide surface and is electrically connected with the conductive cable.

5. The track light according to claim 4, wherein the conductive cable comprises a first conductive cable and a second conductive cable with opposite electric properties, the first conductive cable and the second conductive cable are mutually staggered in the thickness direction, the elastic conductive terminal comprises a first elastic conductive terminal and a second elastic conductive terminal, the first elastic conductive terminal and the second elastic conductive terminal are mutually staggered in the thickness direction, the first elastic conductive terminal is electrically connected with the first conductive cable, and the second elastic conductive terminal is electrically connected with the second conductive cable.

6. The track light according to claim 5, wherein two of the first conductive cables and two of the second conductive cables are provided, the two of the first conductive cables are oppositely disposed along the width direction, and the two of the second conductive cables are oppositely disposed along the width direction;

two of the first elastic conductive terminals and two of the second elastic conductive terminals are provided, the two of the first elastic conductive terminals are disposed back to back along the width direction and are electrically connected with the two of the first conductive cables respectively, and the two second elastic conductive terminals are disposed back to back along the width direction and are electrically connected with the two of the second conductive cables respectively.

7. The track light according to claim 2, wherein a terminal guide slot extending along the width direction is provided inside the driving housing, and the elastic conductive terminal is disposed in the terminal guide slot.

8. The track light according to claim 7, wherein the elastic conductive terminal comprises a conductive pin, an elastic member and a conductive sheet; the conductive pin is configured to extend out of the driving housing and electrically connect with the conductive cable, the conductive pin is further provided with an abutting part, two ends of the elastic member is abutted with the abutting part and the terminal guide slot respectively, and the elastic member applies an acting force to make the conductive pin extend out of the driving housing, the conductive sheet is disposed at a side of the abutting part facing away from the elastic member and abutted with the abutting part when the conductive pin is electrically connected with the conductive cable, and the output terminal is electrically connected with the conductive sheet.

9. The track light according to claim 8, wherein the conductive sheet is provided with an assembly gap, and the conductive pin extends in through the assembly gap.

10. The track light according to claim 8, wherein the terminal guide slot is provided with a clamping connection opening, and the conductive sheet is clamped into the clamping connection opening.

11. The track light according to claim 3, wherein the cavity wall is provided with a first clamping slot, and the insulating member is in clamping connected in the first clamping slot.

12. The track light according to claim 2, wherein the guide track comprises a first magnetic member fixed on the cavity bottom, the driving power source comprises a second magnetic member fixed at a side of the driving housing facing away from the output terminal, and the first magnetic member and the second magnetic member are fixedly connected by magnetic adsorption.

13. The track light according to claim 12, wherein the cavity bottom is provided with a second clamping slot, and the first magnetic member is fixed in the second clamping slot.

14. The track light according to claim 12, wherein the first magnetic member is a magnetic metal plate, and the second magnetic member is a magnet.

15. The track light according to claim 1, wherein the light source further comprises a lens covering the connection opening and in clamping connection with the accommodating cavity, and the light emitting component is fixedly connected with the lens.

* * * * *